US008136692B2

(12) United States Patent
Horsburgh

(10) Patent No.: US 8,136,692 B2
(45) Date of Patent: Mar. 20, 2012

(54) ANTI-ROLL STABILIZER FOR CYLINDRICAL CONTAINERS

(75) Inventor: Thomas E. Horsburgh, West Milford, NJ (US)

(73) Assignee: Ridgid Paper Tube Corporation, Wayne, NJ (US)

( * ) Notice: Subject to any disclaimer, the term of this patent is extended or adjusted under 35 U.S.C. 154(b) by 880 days.

(21) Appl. No.: 11/821,397

(22) Filed: Jun. 22, 2007

(65) Prior Publication Data

US 2008/0314912 A1 Dec. 25, 2008

(51) Int. Cl.
*B65D 25/24* (2006.01)
*B65D 90/12* (2006.01)

(52) U.S. Cl. ..... 220/634; 220/212; 220/605; 220/630; 220/638; 220/729; 206/446; 229/4.5; 229/5.7; 229/93

(58) Field of Classification Search ..... 220/212, 220/605, 614, 625, 628, 630, 634, 635, 638, 220/729, 916; 229/4.5, 5.7, 93
See application file for complete search history.

(56) References Cited

U.S. PATENT DOCUMENTS 171,521 A * 12/1875 Lawrence ..... 211/62
297,468 A * 4/1884 Stevens ..... 220/611
477,618 A * 6/1892 Becher ..... 43/117
691,613 A * 1/1902 Doyle ..... 220/592.16
818,613 A * 4/1906 Daly ..... 220/630
847,617 A * 3/1907 Stapley ..... 403/282
916,325 A * 3/1909 Kelly ..... 430/501
1,101,286 A * 6/1914 Jones ..... 220/824
1,351,496 A * 8/1920 Charles ..... 215/329
1,698,683 A * 1/1929 Reynolds ..... 232/43.2
1,701,729 A * 2/1929 Robertson ..... 220/635
2,460,434 A * 2/1949 Salem ..... 206/407
2,535,871 A * 12/1950 Seigh ..... 222/542
D164,572 S * 9/1951 Happe ..... D7/624.1
2,589,967 A * 3/1952 Sawyer ..... 215/376
2,689,469 A * 9/1954 Happe et al. ..... 220/630
2,907,486 A * 10/1959 Perez ..... 220/4.26
2,936,926 A * 5/1960 Miller ..... 220/571
2,997,199 A * 8/1961 Reachl ..... 220/23.86
3,004,684 A 10/1961 Lightburn
3,115,986 A * 12/1963 Grof ..... 220/495.08
3,233,728 A * 2/1966 Johnson et al. ..... 206/395
3,348,800 A * 10/1967 Wiechers ..... 248/346.11
3,402,844 A * 9/1968 Chin ..... 215/393
3,598,271 A * 8/1971 Holley ..... 215/227
3,756,392 A 9/1973 Oehlmann (Continued)

*Primary Examiner* — J. Gregory Pickett
*Assistant Examiner* — Ned A Walker
(74) *Attorney, Agent, or Firm* — McCarter & English, LLP

(57) ABSTRACT

An anti-rolling device for cylindrical containers, such as mailing tubes, has a stabilizing member with an internal aperture for inserting over a portion of the container. The outer periphery of the device is irregular, e.g., having flats, such that resting on a flat lowers the container to a stable position, and requires energy to rotate beyond the flat and consequently lift the container. The device may be slipped over a plug type cap or placed directly over the body of the container. In alternative embodiments, the device is provided in the form of a gasket, is made from a foam material, is split and resiliently grabs the container or has an elastic band holding it tightly to the container. The various embodiments may be used to retrofit an existing container. The stabilizer may be provided with one or more radial tabs, which may have burrs to grip the receptacle and/or feature a constraining ring to lock the cap into the receptacle. The stabilizer may be used to hold a container upright or constitute an indicia bearing surface.

20 Claims, 8 Drawing Sheets

U.S. PATENT DOCUMENTS 3,927,786 A * 12/1975 Aboud ..... 220/4.01
4,259,827 A 4/1981 Stohlquist
D261,592 S * 11/1981 Wilson ..... D7/624.2
4,380,447 A 4/1983 VanderLugt, Jr.
4,444,313 A 4/1984 Tyson
4,504,009 A 3/1985 Boik et al.
4,516,892 A * 5/1985 Curro, Jr. ..... 410/155
4,761,319 A 8/1988 Kraus et al.
4,858,777 A * 8/1989 Morel ..... 215/295
4,877,133 A 10/1989 Klenter et al.
5,005,759 A 4/1991 Bouche
5,150,804 A * 9/1992 Blanchet et al. ..... 220/212
D331,792 S * 12/1992 Wilcox ..... D23/206
5,261,554 A * 11/1993 Forbes ..... 220/592.16
5,295,598 A * 3/1994 Gerlach et al. ..... 215/376
5,337,895 A 8/1994 Mitelman et al.
5,421,471 A * 6/1995 Burgan ..... 215/355
5,474,206 A * 12/1995 Herring, Sr. ..... 220/636
5,497,621 A * 3/1996 Mallett ..... 60/325
5,518,135 A * 5/1996 Freund ..... 220/796
5,660,292 A * 8/1997 Scholfield ..... 220/212.5
5,829,592 A 11/1998 Henry, Jr. et al.
5,897,018 A * 4/1999 Pruitt ..... 220/603
6,135,307 A * 10/2000 Fahy ..... 220/574
6,164,473 A * 12/2000 Waldrip ..... 215/378
6,398,050 B1 * 6/2002 Allora ..... 215/228
D513,983 S 1/2006 Erdie
D513,984 S 1/2006 Erdie
7,296,729 B2 * 11/2007 Erdie ..... 229/125.17
7,296,730 B2 * 11/2007 Erdie ..... 229/125.17
7,341,220 B2 * 3/2008 Katayama ..... 242/614
7,581,670 B2 * 9/2009 Erdie ..... 229/5.5
2003/0042265 A1 * 3/2003 Hatch ..... 220/630
2004/0016855 A1 * 1/2004 Berry et al. ..... 248/146
2004/0134820 A1 7/2004 Katayama
2005/0072838 A1 4/2005 Erdie
2005/0082192 A1 4/2005 Smarr et al.
2005/0173504 A1 8/2005 Erdie
2005/0205648 A1 9/2005 Erdie
2005/0205649 A1 9/2005 Erdie
2006/0191945 A1 * 8/2006 Kao ..... 220/638
2007/0131738 A1 6/2007 Erdie

* cited by examiner

ANTI-ROLL STABILIZER FOR CYLINDRICAL CONTAINERS

BACKGROUND OF THE INVENTION

1. Field of the Invention

The present invention relates to storage containers and, more particularly, to apparatus and methods for stabilizing containers which have a generally cylindrical shape against rolling.

2. Related Art

Containers having a generally cylindrical shape have been known and used for many years. As used herein, "cylindrical container" or "generally cylindrical container" shall mean any container having a generally cylindrical shape, including elongated containers having a multi-sided cross-sectional shape, such as square, pentagonal, hexagonal, octagonal, etc. Cylindrical containers are useful for containing any type of item and particularly items having a sheet-like configuration, such as documents, maps and posters, in that the sheet may be rolled and inserted into the cylindrical container. Rolling a sheet permits it to assume a compact configuration, while avoiding folding or creasing the sheet. In addition, a closed cylindrical container exhibits good structural integrity and strength, such that strong lightweight containers can be made from common materials, such as cardboard. Owing to the foregoing features, cylindrical containers like mailing tubes are popular for storing and transporting items. Due to their shape, cylindrical containers are inherently capable of rolling on a supporting surface. In most instances, rolling of the cylindrical container is not desirable, e.g., during shipping or other handling, in that rolling may damage the contents of the container and/or make transport of the container less manageable, e.g., allowing cargo to shift out of a desired position within a cargo containment area of a vehicle, rolling off sorting tables, and the like.

Solutions for preventing cylindrical containers from rolling have been proposed in the past. Notwithstanding, there is a need for improved apparatus and methods for preventing cylindrical containers from rolling.

SUMMARY OF THE INVENTION

The limitations of prior art container devices and methods are addressed by the present invention, which includes a device and method for reducing the propensity of a generally cylindrical container having a receptacle portion and a closure to roll on a given environmental surface. The device includes a stabilizing member having lateral and longitudinal extension and an aperture therein extending approximately perpendicularly to the lateral and longitudinal direction of extension of said stabilizing member. An external peripheral surface of the stabilizing member is adapted to contact the environmental surface, the external peripheral surface varying in distance from the aperture along its extent. The aperture is dimensioned to receive at least a portion of the container therein such that when the container is inserted into the aperture and the container with the stabilizing member installed thereon is placed on the environmental surface, the stabilizing member tends to assume at least one orientation representing a relative minimum spacing of the container from the environmental surface. The stabilizing member bears against the container and exerts a force resisting the tendency of the container to roll.

BRIEF DESCRIPTION OF THE DRAWINGS

For a better understanding of the present invention, references is made to the following Detailed Description of the Invention, taken in connection with the accompanying drawings, in which.

DETAILED DESCRIPTION OF THE INVENTION

Figure 1:
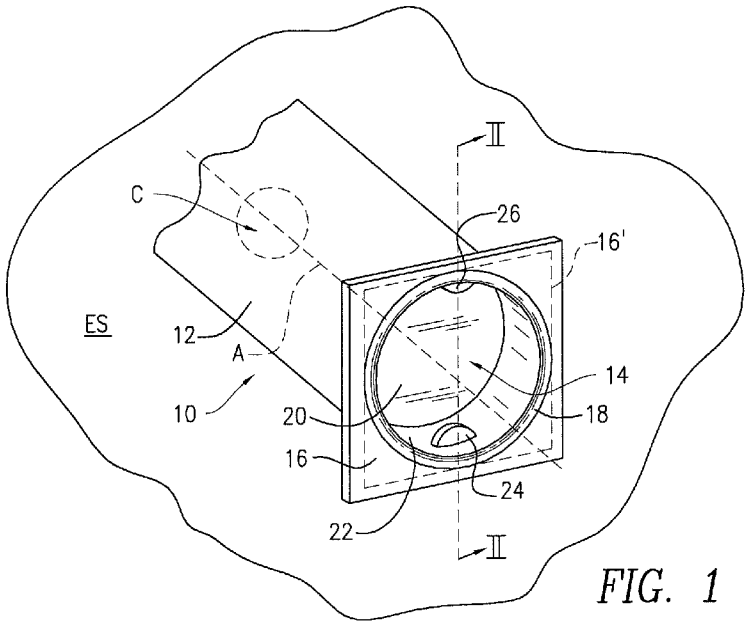
FIG. 1 is a perspective view of a stabilized container system in accordance with a first embodiment of the present invention.
Figure 2:
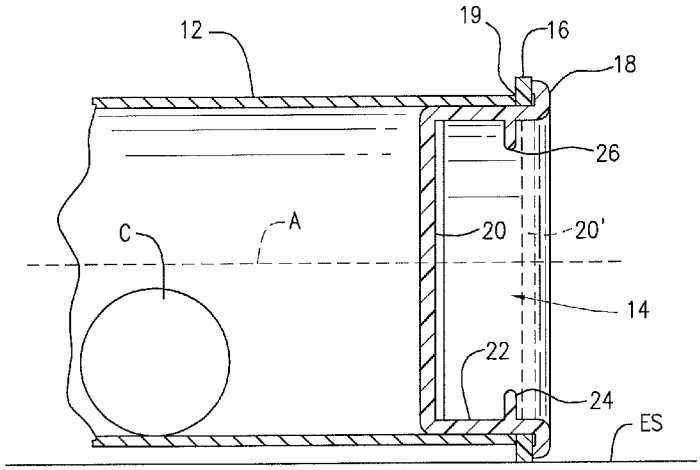
FIG. 2 is a cross-sectional view of the container system of FIG. 1 taken along section line II-II and looking in the direction of the arrows.

FIG. 1 and FIG. 2 show a stabilized container system 10 having a generally cylindrical receptacle 12 for containing objects/contents C, such as documents, parts or any other objects that are to be shipped from a sender to a receiver, e.g., via a parcel delivery service or the post office, or simply stored in the receptacle 12. The container system 10 rests on a surface, such as a shelf, table or truck bed which is referred to herein in general terms as an "environmental surface" ES. The receptacle 12 is in the form of a cylinder, but could have other cross-sectional shapes, such as square, hexagonal or octagonal, etc. A closure 14 (cap or plug) is slideably received within an opening at one end of the receptacle 12 to capture the contents C within the receptacle 12. A similar closure (not shown) to that of closure 14 may be provided at the other end of the receptacle 12. Alternatively, only one end of the receptacle 12 may be provided with a removable closure 12—e.g., the other end of the receptacle may be closed by a fixed cap or plug, e.g., one that is glued or crimped or otherwise fixedly attached on the receptacle 12.

A stabilizer member (or as more simply referred to hereinafter, "stabilizer") 16, which shall be described further below, is captured between a lip 18 of the closure 14 and the receptacle 12. The closure 14 has an end wall 20 and a peripheral wall 22. One or more optional finger pulls 24, 26 extend from the interior surface of the peripheral wall 22 to provide a structure that may be engaged by a finger(s) to remove the closure 14 from the receptacle 12 to access the contents thereof. As shown in FIG. 1, the dimensions of the stabilizer 16 can be varied, depending upon the functionality desired. For example, a stabilizer 16' is depicted in dashed lines, which is substantially co-extensive with the lip 18 of the closure 14 at four locations. In this manner, when the container system 10 is a rest on a surface, it will tend to rest flat on the surface and no (opening) torque will be applied by the stabilizer 16' on the closure 14. Alternatively, an over-size stabilizer 16 can be used to maintain the receptacle 12 at a given angle relative to the supporting surface or when the stabilizer 16 is formed from a flexible material which bends until the receptacle 12 rests on the supporting surface. Portions of the stabilizer 16 or 16' which protrude beyond the lip 18 can be used for gripping to aid in removing the closure 14.

As shown in dashed lines in FIG. 2, an end wall 20' may occupy a position at or proximate to the lip 18, in which case, the end wall 20 would not be present, accommodating a greater volume in the container system 10. An end wall 20' disposed proximate to the lip 18 may have an outward or inward bulge in lieu of the flat configuration shown and may form a gripping surface in lieu of finger pulls 24, 26.

Figure 3:
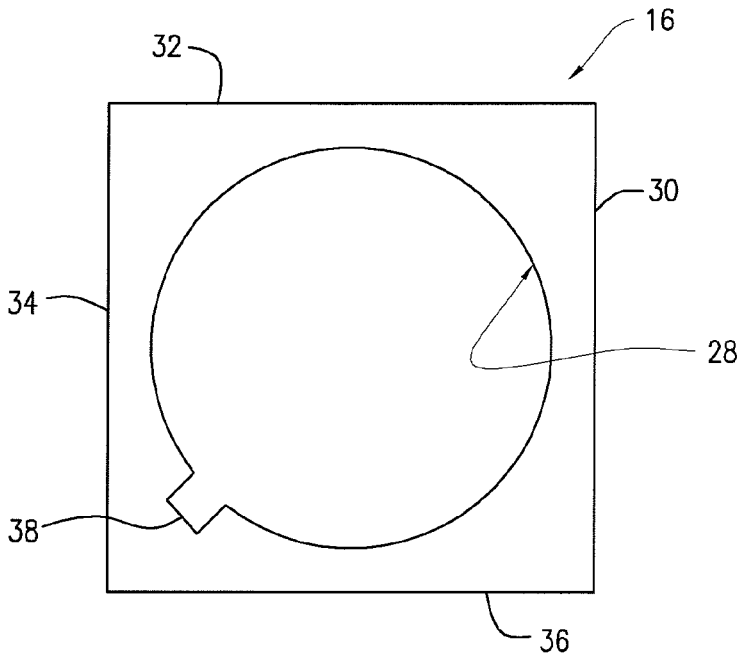
FIG. 3 is a front view of a stabilizer of the container system of FIG. 1.

FIG. 3 shows the stabilizer 16, which has an internal aperture 28 that receives the peripheral wall 22 of the closure 14 therethrough. The stabilizer 16 has a plurality of peripheral surfaces 30, 32, 34, 36, that contact/engage a supporting surface (e.g., a shelf, table or bed surface, such as on a delivery truck) on which the container system 10 is placed. The aperture 28 may be dimensioned relative to the outer dimensions of the peripheral wall 22 to exert a desired amount of frictional interaction therewith, e.g., so that the stabilizer 16 grips the peripheral wall 22 to resist turning the stabilizer 16 relative to the closure 14 and/or so that the stabilizer 16 grips the closure 14 such that the stabilizer 16 and closure 14 may be assembled together and then handled as a unit, e.g., for insertion into the open end of the receptacle 12.

Alternatively, the stabilizer 16 may fit loosely about the closure 14 to permit easy assembly. A frictional interaction may be established between the stabilizer 16, the lip 18 and the open end 19 of the receptacle 12. More specifically, when the stabilizer 16 is captured between the lip 18 and the receptacle 12, insertion of the closure 14 fully into the receptacle 12 will cause the lip 18 and receptacle 12 to frictionally engage the stabilizer 16 to resist relative rotation therebetween. Accordingly, in the embodiment shown in FIG. 1 and FIG. 2, the stabilizer 16 may be held in a selected orientation relative to the closure 14 and/or the receptacle 12 by frictional engagement. The orientation of the closure 14 relative to the receptacle 12 may also be maintained by the frictional engagement between the outer surface of the peripheral wall 22 of the closure 14 and the inner surface of the receptacle 12.

The surfaces 30, 32, 34, 36 of the stabilizer 16, provide support surfaces that may fully or partially abut against an environmental support surface, such as a shelf, table or cargo bed, preventing the container system 10 from rolling on the environmental support surface. It should be appreciated that even a loosely fitted stabilizer 16 will exert frictional drag that will reduce the tendency of the container system 10 to roll. While the embodiment illustrated in FIGS. 1-3 utilizes a press-fit, smooth, plug-type closure 14, the closure 14 may also be held in association with the receptacle 12 by glue or other conventional structures utilized for holding closures to open ends of receptacles, e.g., the receptacle 12 may feature a partially deformable plastic rim with a groove for receiving a peripheral ring formed on an exterior peripheral surface of the closure 14 (not shown). One or more optional slots 38 may be employed to register with mating tabs extending from the receptacle 12 or the closure 14 to prevent relative rotation therebetween.

Figure 4:
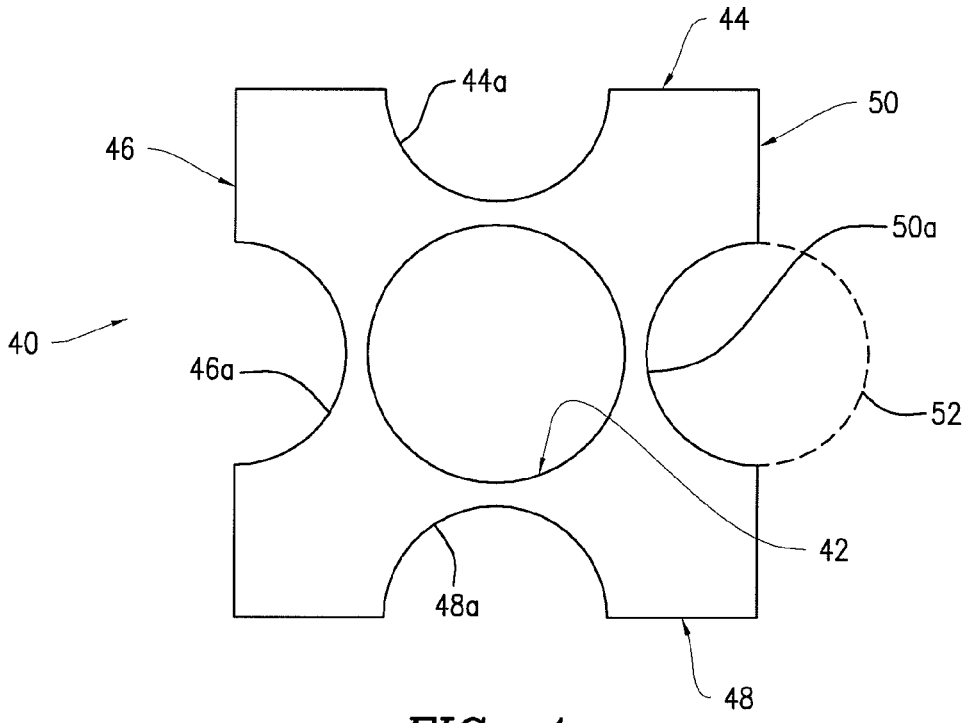
FIG. 4 is a front view of a stabilizer in accordance with an alternative embodiment of the present invention.

FIG. 4 shows a nesting stabilizer 40 with a central aperture 42 similar in form and function to aperture 28 of stabilizer 16, previously described, i.e., a closure 14 may inserted into the central aperture 42. The nesting stabilizer 40 has peripheral support surfaces 44, 46, 48, 50, each of which has a concavity, 44*a*, 46*a*, 48*a* and 50*a*, respectively, which may receive some portion of an adjacent container 52 therein. In this manner, the nesting stabilizer 40 can be used to retain a plurality of adjacent containers 52 at a position and orientation relative to each other, e.g., in an ordered stack with horizontal rows and vertical columns. Each member of a group of adjacent containers 52 may be provided with a nesting stabilizer, or they may be utilized in an alternating manner, e.g., the first and subsequent odd numbered rows of adjacent containers 52 may be provided with nesting stabilizers 40, with the even rows of adjacent containers 52 either having or not having nesting stabilizers 40. The nesting stabilizers 40 can be used on one or both ends of the containers 52 and they may be used in alternating fashion between the front and back of adjacent containers 52.

Figure 5:
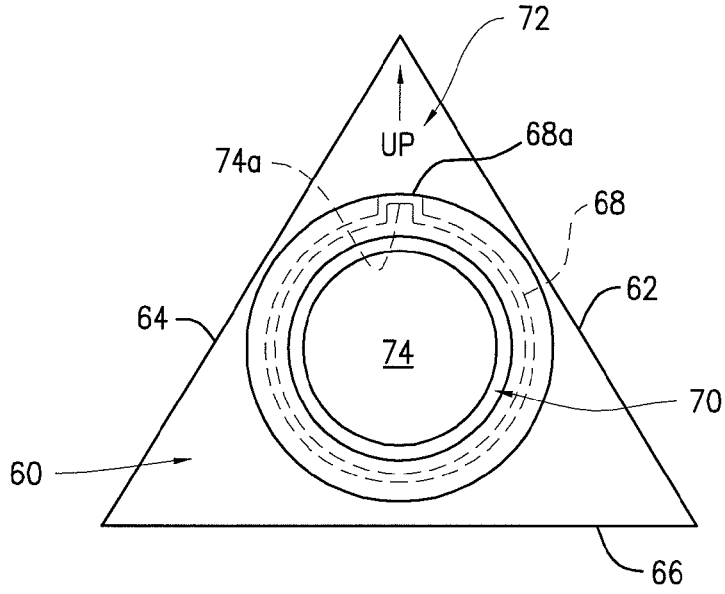
FIG. 5 is a front view of a stabilizer in accordance with another alternative embodiment of the present invention.

FIG. 5 shows a directional stabilizer 60 with a plurality of support surfaces 62, 64, 66 and a central aperture 68 that may be used to hold a generally cylindrical container 70 in a particular orientation. More particularly, the aperture 68 has a rotation stop 68*a* which cooperates with a mating rotation stop 74*a* associated with a closure 74. The rotation stops 68*a* and 74*a* are depicted, respectively, as a singular mating recess 68*a* in the directional stabilizer 60, which receives a singular tab 74*a* extending from the closure 74. The singular tab-type rotation stop 74*a* may extend from the exterior peripheral surface of a peripheral wall 22 of a closure 14 like that shown in FIG. 1 and FIG. 2. Alternatively, the positions of the tab 74*a* and recess 68*a* could be reversed, the tab and recess could have different mating shapes than those shown, and there could be a plurality of mating tabs and recesses, rather than a single tab and recess. As shall be seen from the following description of FIG. 6, there are alternative locations for locating a rotation stop 74*a* on the container, besides the exterior peripheral surface of peripheral wall of the closure 74. The directional stabilizer 60 may optionally be marked with indicia 72 indicating a particular orientation for storage or shipping of the container 70.

Figure 6:
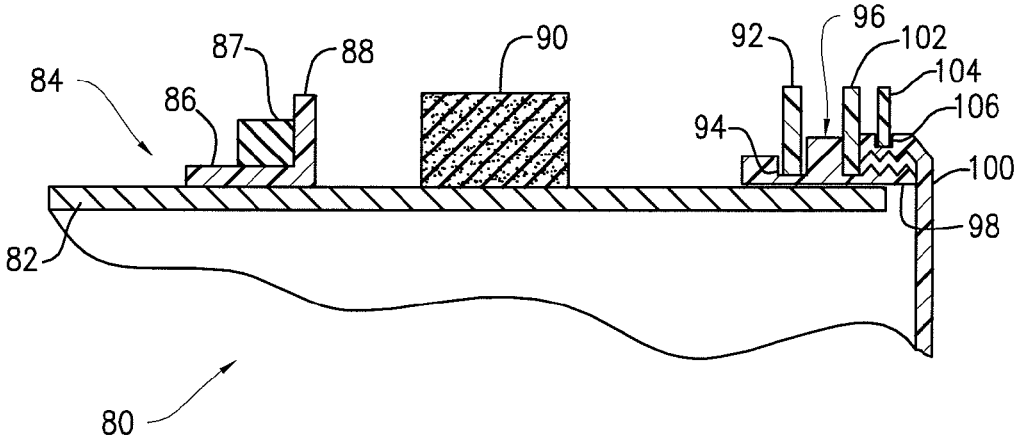
FIG. 6 is a partial, cross-sectional view of a container system like that shown in FIG. 1 and FIG. 2, but showing a variety of stabilizer apparatus in accordance with a corresponding variety of embodiments of the present invention.

FIG. 6 shows a stabilized container system 80 with receptacle 82 and a plurality of alternative stabilizers 84, 90, 92, 102 and 104, each of which may be provided with an overall configuration like that exhibited by the stabilizers 16, 40 and 60 of FIGS. 1-5. Flange-type stabilizer 84 has a receptacle contact ring 86 and a support surface engager 88. The inner circumference of the contact ring 86 may be selected to match the outer circumference of the receptacle. Alternatively, the stabilizer 84 may be split or have a "C"-shaped profile and be made from a resilient material, such as plastic, such that it exerts an inwardly directed resilient force. As a further alternative, a split flange-type stabilizer 84 may utilize an elastic band 87 to retain it in position on the receptacle 82. As noted, when viewed from the front, the support surface engager 88 would have a profile like that of stabilizers 16, 40 or 60 as shown in FIG. 3, FIG. 4 or FIG. 5, respectively.

The shape of block stabilizer 90 differs from the stabilizers 16, 40, 60 in having a greater thickness. Block stabilizer 90 may be made from a low density material, such as Styrofoam, sponge or paper mache, from plastic or a combination of materials and is sized to be positioned over the receptacle 82 of the container 80 and may elastically grip the container 80.

A tube rim 96, e.g., made from plastic or metal may be glued or formed/crimped onto the end of receptacle 82 to provide features, e.g., threads, that promote effective coupling with closure 100, which, in the embodiment depicted, is a threaded cap. The tube rim 96 may have a groove 94 for receiving a tube rim stabilizer 92. The tube rim stabilizer 92 may have the same basic configuration as the stabilizers 16, 40 or 60, except that the central aperture thereof is sized to permit installation in the groove 94 on the tube rim 96. FIG. 6 shows that a gasket-style stabilizer 102 may be captured between the closure 100 and a portion of the tube rim 96. As before, the gasket-type stabilizer 102 may have the same basic configuration as the stabilizers 16, 40 or 60, except that the central aperture thereof is sized to permit installation between the tube rim 96 and the closure 100, as shown in FIG. 6.

FIG. 6 shows yet another alternative wherein a cap stabilizer 104 may be retained in a groove 106 in an outer peripheral surface of closure 100. A rotation stop like 68*a* or 74*a* may be formed in any of the surfaces of the tube rim 96 or closure 100 which contact the stabilizers 92, 102, 104.

A stabilizer, e.g., 16, 40, 60, 84, 90, 102 or 104 is, in accordance with the present invention, retrofittable to existing cylindrical containers and its use on one or both ends thereof is optional. More particularly, one may use the embodiments of the present invention shown in FIGS. 1-5 and the gasket-type stabilizer 102 shown in FIG. 6, by placing the stabilizer between the closure, e.g., 14 and the receptacle 12 and then placing the closure, e.g., 14 on the receptacle 12. As shown in FIG. 3 and FIG. 5, a stabilizer, e.g., 16 or 60 with a registration slot 38/rotation stop 68*a*, respectively, is preferably aligned with any mating rotation stop, e.g., 74*a* before seating the closure on the receptacle 12. As to the embodiments of the invention shown in FIG. 6, with the exception of the gasket-type stabilizer 102, the stabilizers 84, 90, 92 and 104 may be placed on their respective positions on the container system 80 either before or after the closure 100 is placed on the receptacle 82, i.e., by simply sliding the respective stabilizers into position on the container 80. Of course, any of the stabilizers 84, 90, 92 and/or 104 may be placed on the container 80 by a manufacturer, such that the user thereof does not need to assemble the stabilizer to the container 80.

The materials in which a stabilized container system in accordance with the present invention is executed are variable. For example, the container system 10 may utilize a receptacle made from cardboard, plastic, metal or composites thereof. The stabilizer, e.g., 16, 50, etc. may be made from plastic, metal, paper mache, foam rubber, Styrofoam, rubber, cardboard, composites thereof, or other such common materials.

Figure 7:
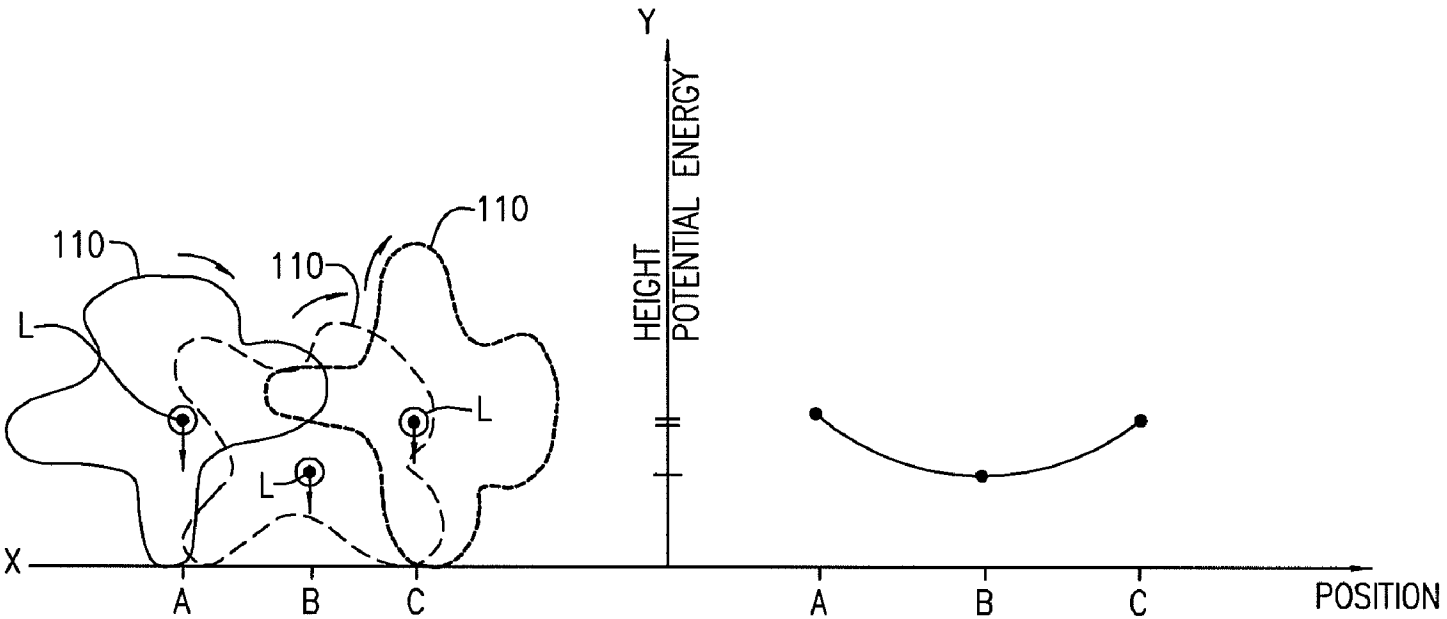
FIG. 7 is a diagram showing three positions of a generalized stabilizer device having a non-circular periphery and an associated graph of the height of a specific load point of the object above a reference level.

FIG. 7 shows the profile of a generalized form of stabilizer 110 which bears a container weight at load point L in three different positions, i.e., with load point L at positions A, B and C, respectively. The generalized stabilizer 110 is depicted in these three different positions with different types of lineation, viz., solid, dashed and dotted lines. The adjacent graph indicates the height of the load point L at each of the three positions A, B and C. The outer periphery of the generalized stabilizer 110 exhibits a varying distance from the load point L, such that the height of the load point L varies (in the Y direction) as the generalized stabilizer 110 is rotated along the X axis from position A to B to C. The potential energy of the system depicted, increases with increasing height of the load. Position B represents a valley or relative minimum of height and potential energy on the positional range shown. As a result, energy must be expended to move the generalized stabilizer 110 from position B to either position A or to position C. Because, position B represents a lower energy level relative to positions A and C, position B could be referred to as exhibiting a relative minimum height/potential energy and the generalized stabilizer 110 and load L will tend to remain at position B and to return to position B if displaced partially toward position A or C. Position B therefore represents a stable height/potential energy valley. Of course, a force exceeding the energy difference between A or C and B would displace the stabilizer 110 from position B, but over the range of difference between A or C and B, it will be stable. Looking back at the previously described stabilizers, e.g., 16, 40 and 60, we can see that the outer peripheral surface(s) thereof vary in distance from the container aperture, e.g., 28, 42, 68 along the extent of the peripheral surface(s), defining stable valleys of height/potential energy when supporting a container relative to an environmental surface ES.

Figure 8:
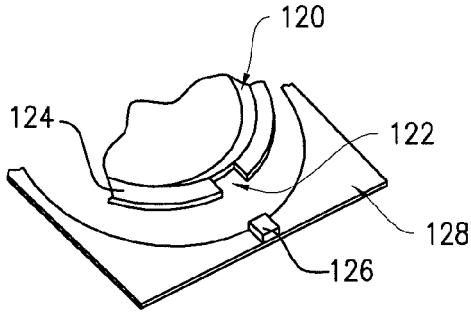
FIG. 8 is a perspective view of a stabilizer and closure in accordance with another alternative embodiment of the present invention.

FIG. 8 shows an end closure 120 having a notch 122 in the peripheral lip 124 thereof. The notch 122 matingly receives a rotation stop block 126 provided on a surface of stabilizer 128. When the stabilizer is captured between a receptacle such as receptacle 12 shown in FIG. 2, the mating of the notch 122 and rotation stop block 126 prevents the stabilizer 128 from rotating relative to the end closure 120. The end closure 120 is typically frictionally engaged with the receptacle 12 which prevents it from being rotated relative thereto without substantial force.

Figure 9:
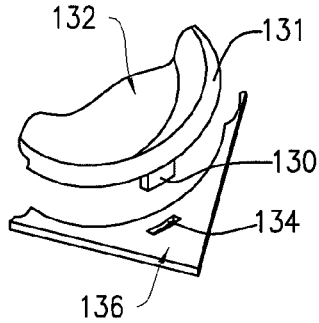
FIG. 9 is a perspective view of a stabilizer and closure in accordance with another alternative embodiment of the present invention.

FIG. 9 shows an alternative arrangement to that shown in FIG. 8, namely, end closure 132 has a depending tab 130 which extends down from the rim 131 of closure 132. The tab is received in a mating slot 134 provided in stabilizer 136. The function of the tab 130 and slot 134 is similar to that of the previously described embodiment shown in FIG. 8, namely, to prevent the stabilizer 136 from rotating relative to the closure 132 and, via the closure's frictional grip on the receptacle, relative to the receptacle.

Figure 10:
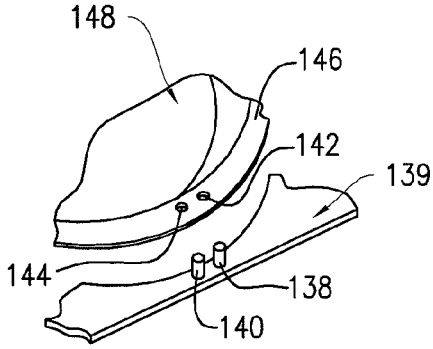
FIG. 10 is a perspective view of a stabilizer and closure in accordance with another alternative embodiment of the present invention.

FIG. 10 discloses another embodiment similar to FIGS. 8 and 9 wherein one or more pegs or other projections 138, 140 extending from a surface of stabilizer 139 insert into holes 132, 144 in the rim 146 of closure 148 to prevent the stabilizer 139 from turning when the closure 148 is inserting into a receptacle 12.

Figure 11:
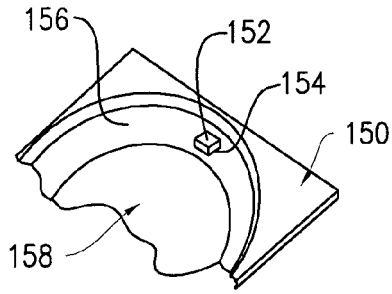
FIG. 11 is a perspective view of a stabilizer and closure in accordance with another alternative embodiment of the present invention.
Figure 12:
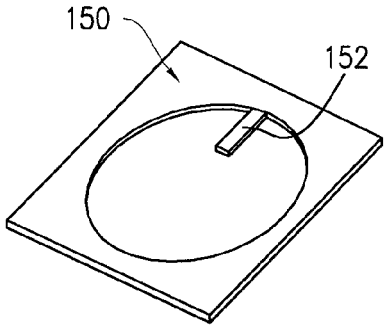
FIG. 12 is a perspective view of a stabilizer in accordance with another alternative embodiment of the present invention.

FIGS. 11 and 12 illustrate another alternative embodiment wherein stabilizer 150 has a radial tab 152 extending into the central aperture thereof. A closure 158 has a tab aperture 154 in the peripheral wall 156 thereof such that when the stabilizer 150 is installed on the closure 158 the tab 152 extends through the tab aperture 154 to prevent rotation of the stabilizer 150 relative to the closure 158.

Figure 13:
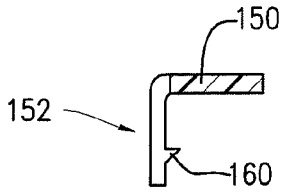
FIG. 13 is an enlarged view of a radial tab which is present in the embodiment of the present invention shown in FIG. 12.

FIG. 13 shows that the radial tab 152 may be bent at an angle relative to the stabilizer 150. The tab 152 also features a burr 160 which may be used to grip a receptacle 12 as illustrated in FIG. 14.

Figure 14:
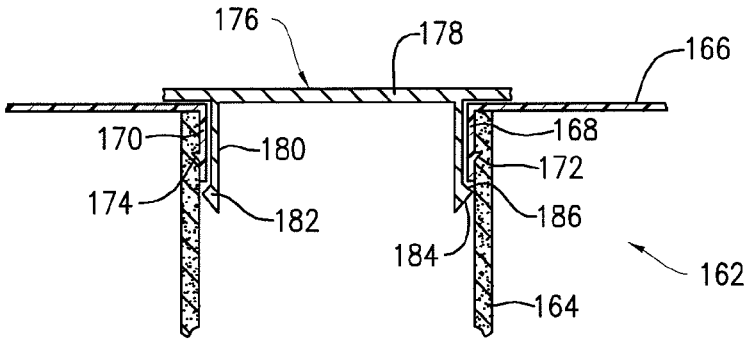
FIG. 14 is a cross-sectional view of a container system utilizing a closure, a receptacle and a stabilizer in accordance with another alternative embodiment of the present invention.

FIG. 14 shows a stabilized container system 162 having a receptacle 164. Stabilizer 166 has a plurality of radial tabs 168, 170 which are bent at right angles relative to the remainder of the stabilizer 166. Stabilizer 166 has a profile similar to that shown in FIG. 1. A pair of burrs 172, 174 extend from a surface of the radial tabs 168, 170 respectively. End closure 176 has an end wall 178 and a cylindrical wall extending substantially perpendicularly relative to the end wall 178 to plug the opening of the receptacle 164. A tapered gripping land 182 is provided proximate the distal end of the cylindrical wall 180. The gripping land 182 has a tapered distal surface 184 which promotes its introduction into the aperture of the stabilizer 166 and into the open end of the receptacle 164. The tapered gripping land 182 also has a proximal surface 186 which abuts against the distal end of the radial tabs 168, 170 to prevent withdrawal of the closure 176 from the receptacle 164. As can be appreciated from FIG. 14, the cylindrical wall 180 of the closure 176 bends the radial tabs 168, 170 downward and presses the burrs 172, 174 into the receptacle 164, which typically would be formed from cardboard, paper or plastic that can be penetrated by the burrs 172, 174. The closure 176 forms an interlocking relationship with the stabilizer 166 to retain the stabilizer 166 in a specific orientation relative to the receptacle 164 to prevent relative rotation between the receptacle 164 and the stabilizer 166 as well as locking the closure 176 into the receptacle 164 by virtue of the interaction between the radial tabs 168, 170 and the proximal surface 186 of the tapered gripping land 182.

Figure 15:
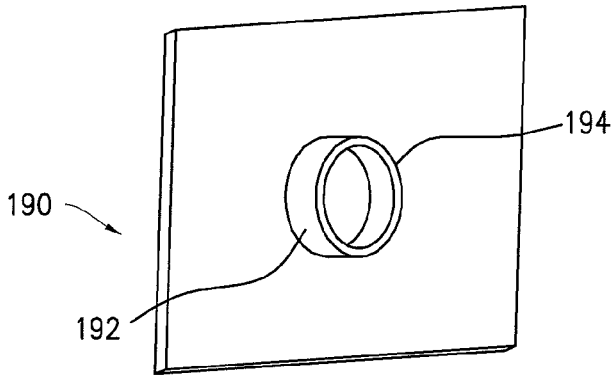
FIG. 15 is a perspective view of a stabilizer in accordance with another alternative embodiment of the present invention.

FIG. 15 shows a stabilizer 190 having a ring 192 which extends substantially at right angles relative to the remainder of the stabilizer 190. A tapered lead-in 194 may be provided on the ring 192 to facilitate it's installation on a receptacle 198 as shown in FIG. 16.

Figure 16:
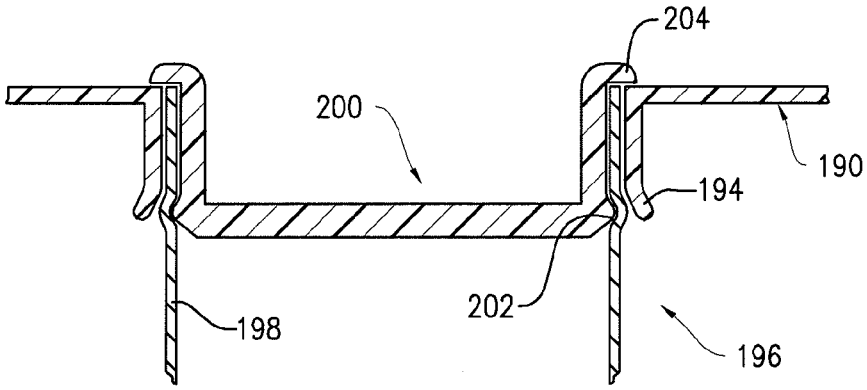
FIG. 16 is a cross-sectional view of a container system in accordance with another alternative embodiment of the present invention.

FIG. 16 illustrates a container system 196 having a receptacle 198 formed from cardboard or plastic. A closure member 200 is inserted into the end of the receptacle 198. The closure 200 has a tapered gripping land 202 which is radially enlarged and grips and/or displaces the wall of the receptacle 198 outward to conform to the shape of the gripping land 202. The tapered lead-in 194 permits the stabilizer 190 to be slipped over the lip 204 of the closure 200 and be pushed down over the end of the receptacle 198 to the extent that the tapered lead-in 194 encounters the area of the receptacle 198 which is deformed by the tapered gripping land 202 of the closure 200. The deformation shown is exaggerated for illustration purposes and may, in practice, be minimal. Simultaneously, the stabilizer 190 clears the edge of the lip 204 of the closure 200, locking the stabilizer 190 on the container system 196. As can be appreciated, the embodiment of the present invention shown in FIG. 16 provides a means for making the withdrawal or inadvertent displacement of the closure 200 from the receptacle more difficult. The stabilizer 190 and closure 200 may feature anti-rotation stops such as shown in FIGS. 8-12 to prevent the rotation of the stabilizer 190 relative to the closure 200 and/or the receptacle 198.

Figure 17:
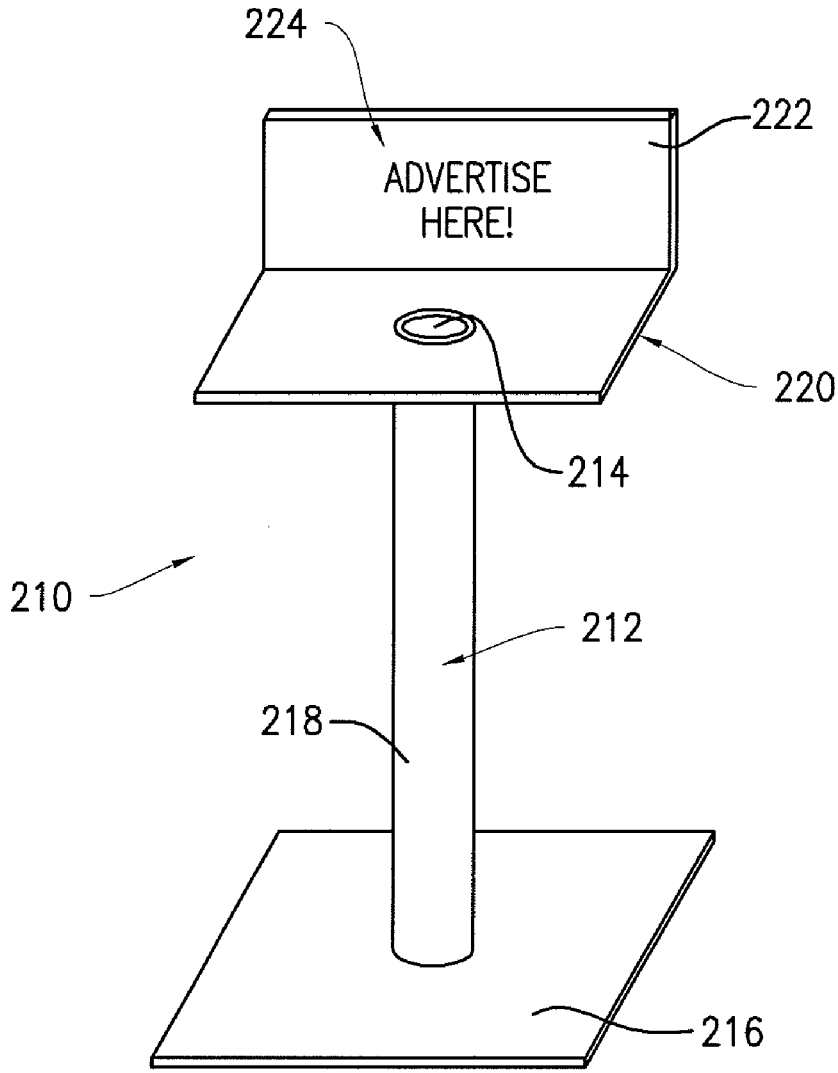
FIG. 17 is a perspective view of a container system in accordance with another alternative embodiment of the present invention.

FIG. 17 shows a columnar assembly 210 having a container system 212 with closures 214 at either end. The closures 214 retain an enlarged stabilizer 216 at one end of the container system 212 which serves as a base or foot for the columnar assembly 210, permitting it to stand upright. At the top, closure 214 retains an upper stabilizer 220. The upper stabilizer 220 may feature one or more panels 222 that may be used as a surface for bearing advertising or other symbology i.e., as a substrate for indicia 224. In lieu of closure 214 and stabilizer 220 at the top of the container system 212, alternative signage or other advertising mechanisms, such as a three dimensional plastic figurine or object may be held on in any convenient and conventional manner, such as by inserting into the open end of the receptacle 218.

Figure 18:
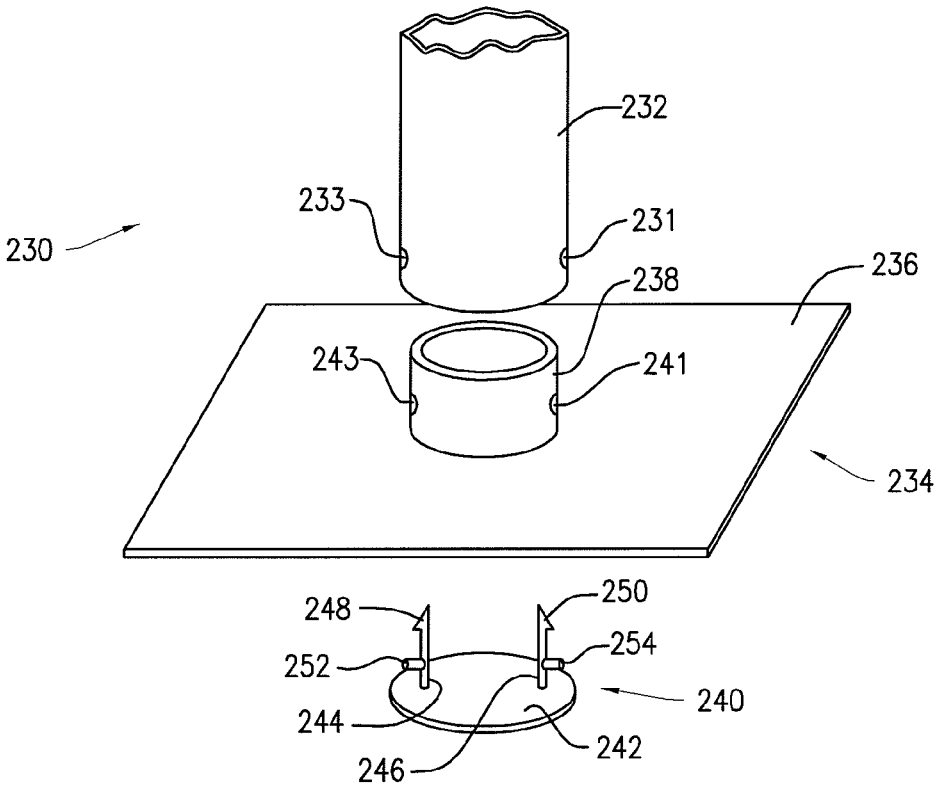
FIG. 18 is an exploded view of a container system in accordance with another alternative embodiment of the present invention.
Figure 19:
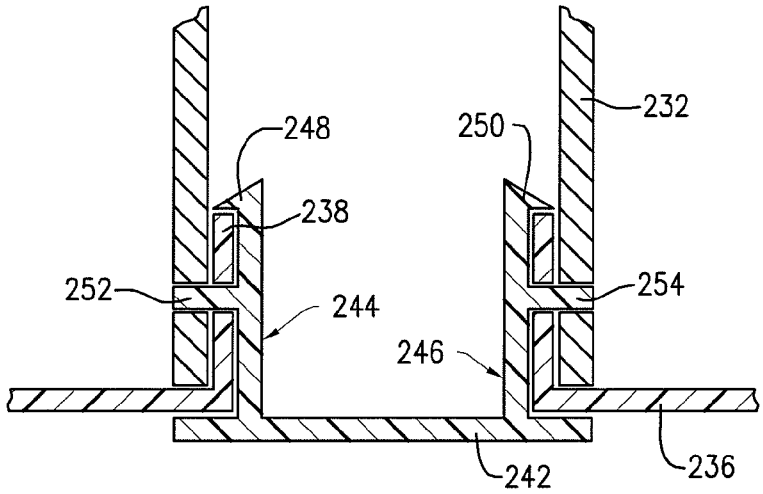
FIG. 19 is a cross-sectional view of the container system of FIG. 18.

FIGS. 18 and 19 show a container system 230 utilizing a receptacle 232 having a pair of opposing apertures 231, 233 proximate an end thereof. A stabilizer 234 has a sleeve 238 extending from a base/flange 236. The sleeve 238 has a pair of opposing apertures 241, 243 which may be aligned with the apertures 231, 233 when the sleeve 238 is inserted into the open end of the receptacle 232. A closure 240 has an end wall 242 from which a pair of spikes 244, 246 extend. The spikes 244, 246 may be provided with heads 248, 250 which facilitate insertion and interlock with the sleeve 238 as shown in FIG. 19. The spikes 244, 246 also feature locator pins 252, 254, respectively, which insert through the aligned apertures 233, 231 and 243, 241, to retain the closure 240 in the end of the receptacle 232 at a specific orientation. This type of container system 230 may be employed to maintain the receptacle 232 in an upright position like that shown in FIG. 17, or may be used to form a stabilized container system for containing objects. For the latter application, the closure 240 may include a cylindrical side wall like wall 180 that is shown in FIG. 14, with the spikes 244, 246 extending from a distal end thereof.

It should be understood that the embodiments described herein are merely exemplary and that a person skilled in the art may make many variations and modifications without departing from the spirit and scope of the invention. For example, the present invention as described above in reference to FIG. 6, shows a container with a tube rim with outer threads, but the invention would be equally applicable for use with a container having a tube rim with inner threads that received a closure with an outer threaded surface. Further, the invention could be utilized with a receptacle, e.g., made from plastic or molded cardboard, having integrally formed threads. It should be appreciated that all the various stabilizers shown in the figures and described above may be formed monolithically with any of the closures or receptacles shown and described herein. All such variations and modifications are intended to be included within the scope of the present invention.

What is claimed is:

1. A container system having an elongated substantially cylindrical receptacle having an axis and bounding an interior receptacle space and at least one plug-type closure with an inserting portion having a circumferential wall and a bottom wall, said inserting portion inserted into an open end of the receptacle and into the interior receptacle space with said bottom wall serving to close the open end of the receptacle, said closure having a peripheral lip extending from an upper end of the circumferential wall which prevents complete insertion of the closure into the open end of the receptacle, said container system comprising: a planar stabilizing member extending in a lateral direction and a longitudinal direction, said stabilizing member having an aperture therein bounded by an internal surface, said aperture extending through the thickness of the stabilizing member in a direction approximately perpendicularly to the lateral and longitudinal directions of extension of said stabilizing member, said inserting portion of the closure inserted within said aperture, said aperture corresponding to a size and a shape of said bottom wall of said closure, said stabilizing member is sandwiched between the lip of the closure and the open end of the receptacle, the stabilizing member contacting a support surface, said stabilizing member bearing against the receptacle when the closure is received in said aperture and thereby preventing the receptacle from rolling.

2. The system of claim 1, wherein the receptacle has an open end and the closure is selectively attachable to and removable from the open end to provide controlled access to the interior of the receptacle and said stabilizing member is in contact with the closure.

3. The system of claim 2, wherein the receptacle has an interior space, the closure is a plug-type closure with an inserting portion which slideably inserts into the open end of the receptacle into the interior space, and a peripheral lip which prevents complete insertion of the plug-type closure into the open end of the receptacle, said aperture of said stabilizing member receiving the inserting portion of the closure, said stabilizing member being captured between the lip and the open end of the receptacle when the inserting portion is inserted therein.

4. The system of claim 3, wherein said stabilizing member frictionally engages the closure.

5. The system of claim 4, wherein said stabilizing member frictionally engages the receptacle.

6. The system of claim 1, wherein the force exerted by the stabilizing member is a frictional force.

7. The system of claim 1, wherein said stabilizing member is made from a foamed polymer.

8. The system of claim 1, wherein the force resisting the receptacle from rolling is conveyed through a mechanical engagement between the receptacle and said stabilizing member.

9. The system of claim 1, further including indicia on said stabilizing member to indicate directional orientation.

10. The system of claim 1, wherein said stabilizing member comprises an external surface, and said external peripheral surface of said stabilizing member has a recess therein to accommodate an adjacent receptacle therein.

11. A container system having an elongated substantially cylindrical receptacle having an axis and bounding an interior receptacle space and at least one plug-type closure with an inserting portion having a circumferential wall and a bottom wall, said inserting portion inserted into an open end of the receptacle and into the interior receptacle space with said bottom wall serving to close the open end of the receptacle, said closure having a peripheral lip extending from an upper end of the circumferential wall which prevents complete insertion of the closure into the open end of the receptacle, said container system comprising: a planar stabilizing member extending in a lateral direction and a longitudinal direction, said stabilizing member having an aperture therein bounded by an internal surface, said aperture extending through the thickness of the stabilizing member in a direction approximately perpendicularly to the lateral and longitudinal directions of extension of said stabilizing member, said inserting portion of the closure inserted within said aperture, said aperture corresponding to a size and a shape of said bottom wall of said closure, said stabilizing member is sandwiched between the lip of the closure and the open end of the receptacle, said stabilizing member is a base supporting the receptacle in an upright orientation with the axis of the receptacle at a substantially perpendicular orientation relative to a supporting surface and with the stabilizing member contacting the supporting surface.

12. The system of claim 11, wherein the receptacle has an open end and the closure is selectively attachable to and removable from the open end to provide controlled access to the interior of the receptacle and said stabilizing member is in contact with the closure.

13. The system of claim 12, wherein the receptacle has an interior space, the closure is a plug-type closure with an inserting portion which slideably inserts into the open end of the receptacle into the interior space, and a peripheral lip which prevents complete insertion of the plug-type closure into the open end of the receptacle, said aperture of said stabilizing member receiving the inserting portion of the closure, said stabilizing member being captured between the lip and the open end of the receptacle when the inserting portion is inserted therein.

14. The system of claim 13, wherein said stabilizing member frictionally engages the closure.

15. The system of claim 14, wherein said stabilizing member frictionally engages the receptacle.

16. The system of claim 11, wherein the force exerted by the stabilizing member is a frictional force.

17. The system of claim 11, wherein said stabilizing member is made from a foamed polymer.

18. The system of claim 11, wherein the force resisting the receptacle from rolling is conveyed through a mechanical engagement between the receptacle and said stabilizing member.

19. The system of claim 11, further including indicia on said stabilizing member to indicate directional orientation.

20. The system of claim 11, wherein said stabilizing member comprises an external surface, and said external peripheral surface of said stabilizing member has a recess therein to accommodate an adjacent receptacle therein.

* * * * *